US011248807B2

(12) United States Patent
Spanger

(10) Patent No.: US 11,248,807 B2
(45) Date of Patent: Feb. 15, 2022

(54) ROUGH-IN BOX FOR HIGH WALL MINISPLIT (DUCTLESS) AIRCONDITIONERS

(71) Applicant: Gerald S. Spanger, Edison, NJ (US)

(72) Inventor: Gerald S. Spanger, Edison, NJ (US)

( * ) Notice: Subject to any disclaimer, the term of this patent is extended or adjusted under 35 U.S.C. 154(b) by 279 days.

(21) Appl. No.: 16/718,678

(22) Filed: Dec. 18, 2019

(65) Prior Publication Data

US 2020/0224890 A1 Jul. 16, 2020

Related U.S. Application Data

(60) Provisional application No. 62/790,584, filed on Jan. 10, 2019.

(51) Int. Cl.

| | |
|---|---|
| ***F24F 1/0043*** | (2019.01) |
| *F24F 13/32* | (2006.01) |
| *F24F 1/32* | (2011.01) |
| *F24F 13/22* | (2006.01) |
| *F24F 1/0003* | (2019.01) |

(52) U.S. Cl.

CPC ..... *F24F 1/0043* (2019.02); *F24F 1/0003* (2013.01); *F24F 1/32* (2013.01); *F24F 13/222* (2013.01); *F24F 13/32* (2013.01); *F24F 2013/227* (2013.01)

(58) Field of Classification Search

CPC ..... F24F 1/0043; F24F 1/0003; F24F 1/32; F24F 13/222; F24F 13/32; F24F 2013/227

See application file for complete search history.

(56) References Cited

U.S. PATENT DOCUMENTS

| | | | | |
|---|---|---|---|---|
| 6,196,015 | B1 * | 3/2001 | Pignolo | F24F 1/0003 62/285 |
| 9,841,209 | B2 | 12/2017 | Alvise et al. | |
| D813,365 | S | 3/2018 | Alvise et al. | |
| 2017/0211842 | A1 * | 7/2017 | Alvise | F24F 13/32 |
| 2019/0145632 | A1 * | 5/2019 | Thomas | F24F 13/20 52/173.1 |

FOREIGN PATENT DOCUMENTS

BR MU 8700323-6 U 10/2008

* cited by examiner

*Primary Examiner* — Joseph F Trpisovsky
(74) *Attorney, Agent, or Firm* — Oliff PLC

(57) ABSTRACT

An evaporator rough-in box includes a flat panel having a first score mark by which the flat panel can be folded between a front wall and a top wall of the rough-in box, and a second score mark by which the flat panel can be folded between the front wall and a bottom wall of the rough-in box. The front wall has an opening through which an interior of the rough-in box can be accessed, the opening being covered by a removable cover plate. Left and right ends of the top and bottom walls include extension pieces bendably attached to central portions of the top and bottom walls to form mounting brackets. The central portions include score marks that delineate knock-out holes by which a lineset and a drain line can be installed to the rough-in box. A drain fitting is attached to the knock-out hole of the drain line.

12 Claims, 10 Drawing Sheets

ROUGH-IN BOX FOR HIGH WALL MINISPLIT (DUCTLESS) AIRCONDITIONERS

This nonprovisional application claims the benefit of U.S. Provisional Application No. 62/790,584, filed Jan. 10, 2019. The entire contents of the prior application is incorporated herein by reference.

BACKGROUND

The disclosure relates to so-called rough-in boxes that can be used during construction to hold various components that are used to support air conditioner systems such as, for example, mini-split air conditioners.

All mini-split air conditioner evaporators require a minimum of two mechanical connections and one electrical connection to operate, namely: (1) a lineset having two or more insulated copper pipes connecting the evaporator to the condenser; (2) a power cable; and (3) a gravity condensate drainage method which usually requires connection to the building's drain pipe system, or may be routed to a convenient drain point outside the building, or may use a pump to evacuate the condensate, for example, in installations where the condensate must be fed upward and thus gravity cannot be utilized to facilitate gravity drainage.

In many countries, to reduce costs, modern interior walls (and some exterior walls) consist of a framework constructed of wooden studs typically used for residential applications, or metal studs typically used for commercial applications. Once all the services such as electrical, plumbing, mechanical, etc. have been installed, this framework is then clad on both sides with Gypsum boards (commonly known as sheetrock) to form a wall with an internal cavity which is often filled with Fiberglass or foam to provide thermal and/or sound insulation.

In new construction, this requires the air conditioning installer to preposition the above-mentioned three inputs into a stud wall frame prior to sheet rocking and this in turn creates at least two problems. First, it is difficult for the installer to determine the correct position of the three inputs relative to the final position of the air conditioner and as a result, they often emerge from the wall in the wrong position, creating substantial problems when they have to be connected during the installation phase. Second, it is necessary for the installer to leave some pipe and cable sticking out of the finished wall so the air conditioner can be installed and connected up after the sheetrock and painting have been completed, and these items (the pipe and cable) are consistently damaged and covered with mud during the sheet rocking process. The items (pipe and cable) are also subject to severe mechanical damage by tradesmen installing other services such as electrical, plumbing, data and alarm.

It is therefore very desirable to provide a way to ensure that these service connections will not only emerge from the wall in the correct orientation to the air conditioner but also that the piping and wiring itself is shielded from damage until such time as it is ready for final connection to the air conditioner. These issues have been addressed in the past by the introduction of a "rough-in box", which is a plastic box pre-mounted into the wall cavity in the approximate position where the air conditioner (having the evaporator unit) is to be placed and which is pre-piped and prewired with all the necessary connections, leaving sufficient slack inside the box so that these services can easily be connected into the air conditioner during the installation process. After initial installation, an open front side of the box with the enclosed wires and piping is covered up with a removable cover plate which is left in place to protect the contents during all subsequent installation activities up to and including the final process of painting. After painting is completed, the cover is removed, exposing the pristine contents ready for connection to the air conditioner.

Installation aids of this nature have been available for some time in various configurations and sizes, however they all have a number of shortcomings and can be improved. There are a number of injection molded plastic boxes available from various European and Asian manufacturers all of which disclose a simple rectangular box with an open front and a sloped drainage sump at the bottom which terminates in a drain outlet. Also included are some knockouts on the top and sides through which the pipes and cables can be introduced into the box. The box may be closed with a separate cover which is attached with screws. A box also is available from Polar of Brazil, which is manufactured under Brazilian Patent Number 8,700,323-6, and which discloses a single piece blow molded box with an integral faceplate and a sloped drainage sump at the bottom which terminates in a drain outlet. Also included are some knockouts on the top and sides. With this single piece blow molded box, the installer must insert the cables and tubing into the box blind (that is, without being able to see the positions of these items within the box).

Alvise and Spanger, in U.S. Pat. No. 9,841,209 also disclose a molded plastic box which incorporates a number of unique features as well. Also see U.S. Design Pat. No. D813,365.

SUMMARY

The products described above all have similar characteristics in that they disclose a rectangular box like structure which is installed into the wall cavity, and into which the lineset, cable and drainpoint are connected during the roughing in phase.

The existing boxes described above have at least three disadvantages. First, they are relatively expensive to manufacture. Second, they are not suitable for 6 inch wall thicknesses at 24 inch stud centers. Third, although they are very light, they are very bulky. This requires much space for storage and heavily increases transportation costs which often are calculated based on volume, not weight.

It can be argued that the only parts of existing boxes which are necessary are: (1) the front face, with removable cover, which provides a stable protruding frame around which the sheetrock contractor can appropriately cut a corresponding hole in the sheetrock; (2) a stable junction point to which the internal and external drainage systems can be connected; and (3) a removable cover plate to protect the contents of the box during building operations.

The present disclosure proposes a rough-in box having the following improvements which are specifically designed to address the issues described above. A rough-in box according to the present disclosure includes one or more of:

(1) A flat panel which, utilizing score marks at various predetermined places on its surface, enables it to be folded up into a 3 sided (front, top, bottom) box shape on the site.

(2) The score marks also enable the box to be used for a nominal 4 inch thick wall, or, when required, to be configured for a 6 inch thick wall.

(3) The front surface of the box incorporates a raised frame ½ inch high so that when the box is installed in the studs, the frame will protrude ½ inch from the stud surface to provide a reference point for the sheetrock installer. The front surface of the frame will be flush with the exterior surface of the sheetrock on the front of the wall.

(4) The frame incorporates two mounting holes which enable a plastic cover plate to be attached to the box after installation, to protect the contents of the box.

(5) The top and the bottom of the box are identically configured with multiple score marks (knockouts) which enable the installer to easily select the optimum point for the lineset to enter the box, either from the top or from the bottom.

(6) The top and bottom of the box also incorporate multiple round score marks, (knockouts) which enable the installer to select the drainage point which best suits the particular installation requirements. These can be sized to accommodate a ¾ inch or ½ inch PVC or copper pipe adapter according to the requirements of the installer.

(7) The top and bottom are identical, therefore the entire assembly is fully reversible and can be installed in any orientation.

(8) Both ends of the top and bottom of the box incorporate extension pieces which are intended to act as mounting brackets for the box. The extension pieces are predrilled as well as scored in multiple places to enable the brackets to be configured for use in studs at 16 inch or 24 inch centers and also to be adjusted to suit the orientation of metal studs.

(9) The box comes with a ¾ inch drain fitting which is supplied loose to enable it to be installed at whatever point is most convenient for the external and/or internal drain connection. It is preferable that the drain fitting be supplied with a removable protective cap attached to the drain fitting to prevent debris from building operations from entering the drain line, which would comprise its integrity. The cap preferably is fitted to the end of the fitting that is located inside the box after installation. The cap is then removed from the fitting when the drain hose from the evaporator is attached to the interior end of the drain fitting during the installation process of the evaporator.

The part of the drain fitting which is inside the box includes a quick connection for the drain hose from the evaporator and is configured to provide either a horizontal or vertical connection.

The part of the drain fitting outside the box is also configured to provide a vertical or horizontal connection for the drainage line.

Rough-in boxes according to the invention can be fabricated from any kind of plastic, or any other kind of non metallic material including fiberglass or carbon fiber and can be produced by injection molding, vacuum molding, rotational molding, blow molding, printing or any other method of fabrication.

Rough-in boxes according to the invention can also be fabricated, pressed, printed or molded from any kind of metal.

The box can be square or rectangular in form or it could also be round, triangular or any other geometric shape which does not interfere with the required function.

As a secondary objective is to provide a definitive framed opening for the sheetrock installer, it is preferable for the box to have a front surface with an opening which protrudes through the sheetrock.

However, an alternative method makes it possible that the front surface could be supported to the studs either by a number of brackets along the top, bottom, or at either or both ends.

Another alternative method could have the front surface supported to the studs by two endplates only, in which case the top and bottom surfaces could be eliminated.

DETAILED DESCRIPTION OF EMBODIMENTS

Figure 1:
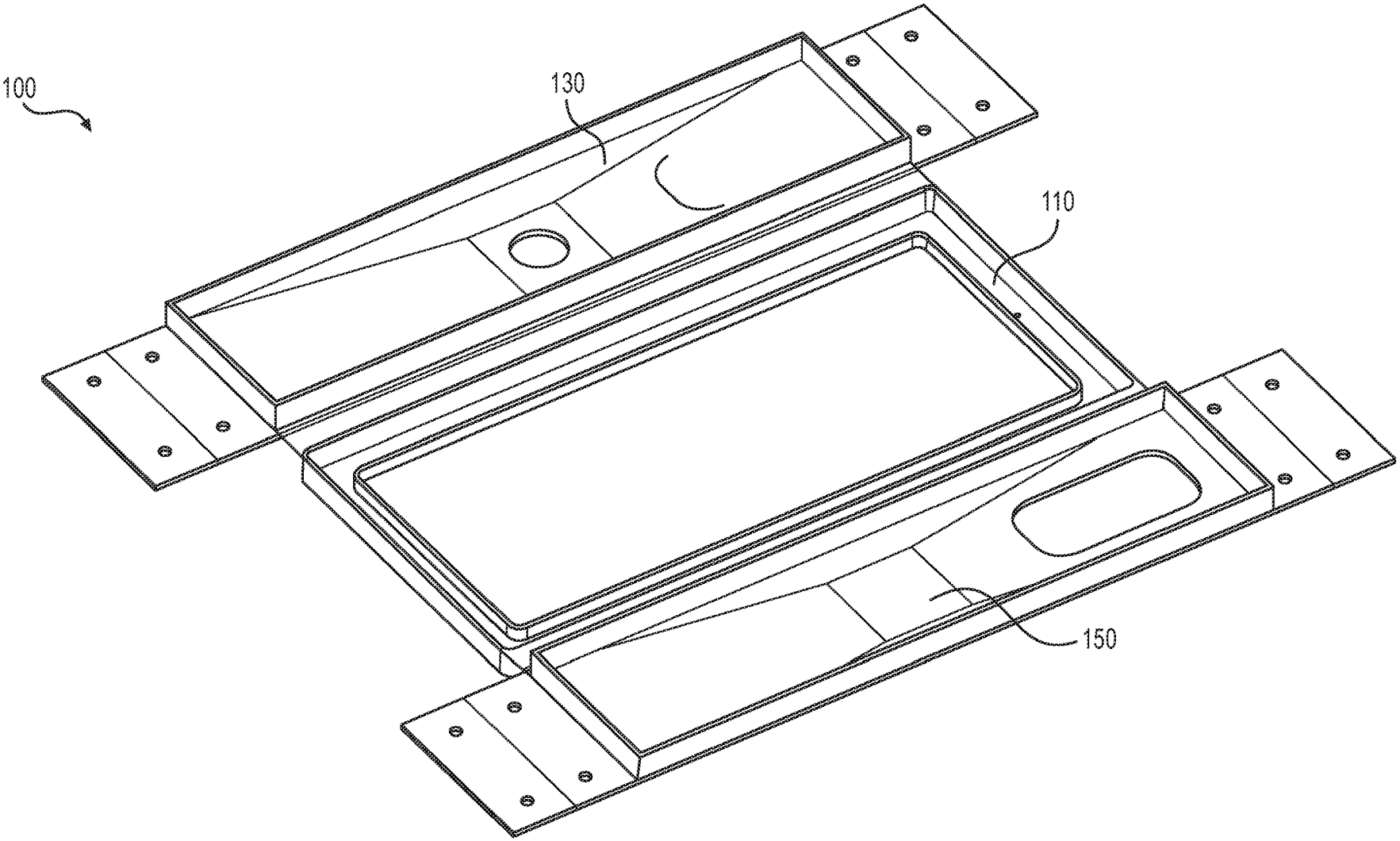
FIG. 1 is a view of an embodiment of the rough-in box in the unfolded (shipping) state as seen from the inside surfaces of the box.

FIGS. 1-10 show a rough-in box 100 according to one exemplary embodiment. Once mounted between two studs, the rough-in box will hold certain components of a mini-split air conditioner system, such as a lineset, drainage components and optionally a pump if collected condensate will need to flow upward to exit the rough-in box. See, for example, U.S. Pat. No. 9,841,209, the entire contents of which is incorporated herein by reference.

The rough-in box 100 is formed from a single, substantially flat panel which, utilizing score marks at various predetermined places on its surface, enables it to be folded up into a 3 sided (front, top, bottom) box shape on the construction site. The score marks also enable the box to be used for a nominal 4 inch thick wall, or, when required, to be configured for a 6 inch thick wall.

The front surface 110 of the box 100 incorporates a raised frame 111 that is ½ inch high (see FIG. 2) so that when the box is installed in the studs, the frame 111 will protrude ½ inch from the stud surface to provide a reference point for the sheetrock installer. The frame 111 surrounds a large opening 112 through which installers can access the lineset and other components (not shown) that will be housed within the box. The front surface of the frame will be flush with the exterior surface of the sheetrock on the front of the wall.

The frame 111 incorporates two mounting holes 113 which enable a plastic cover plate 200 (see FIGS. 9 and 10) to be attached to the box after installation, to protect the contents of the box.

Figure 2:
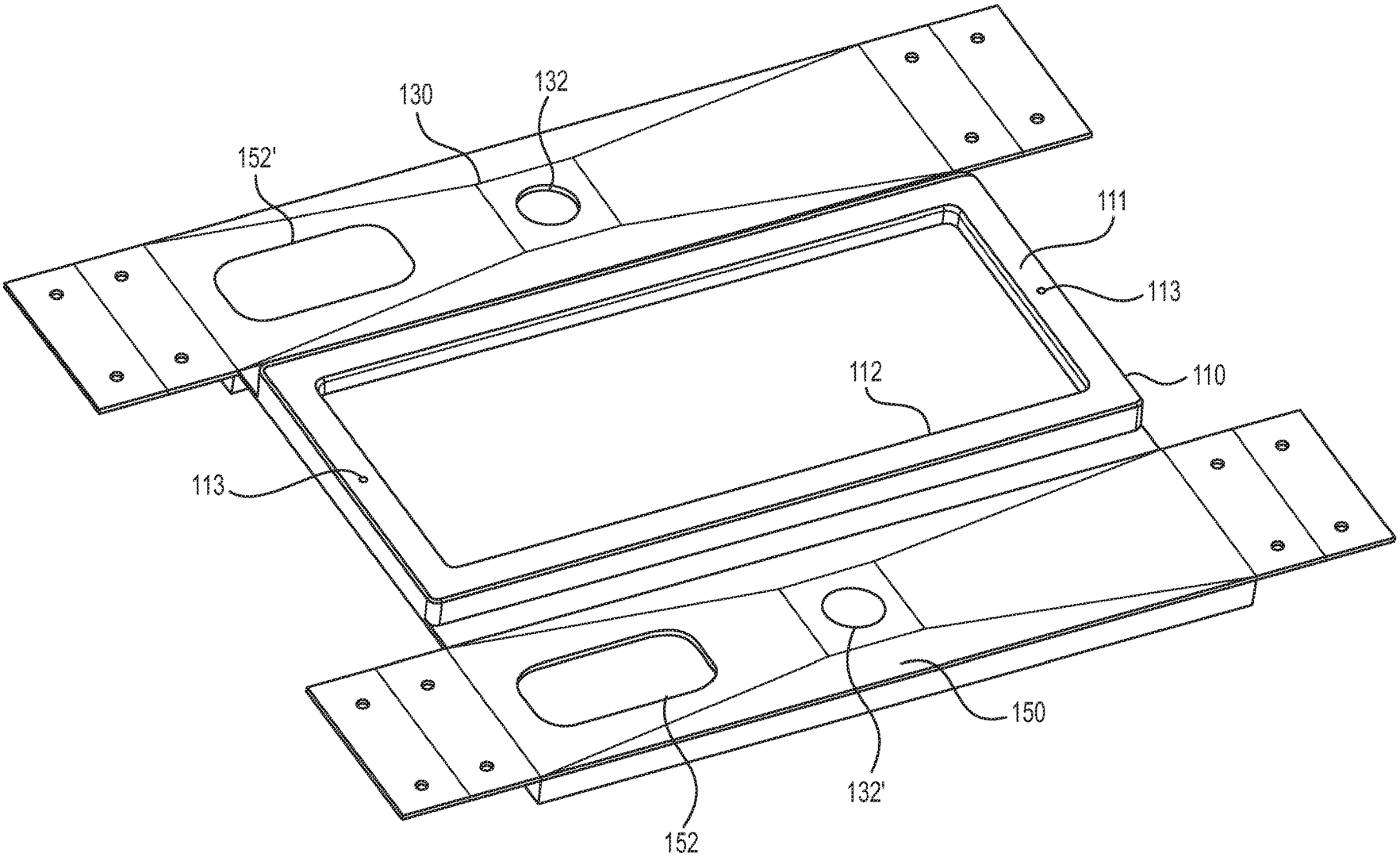
FIG. 2 is a view similar to FIG. 1, but as seen from the outside surfaces of the box.
Figure 3:
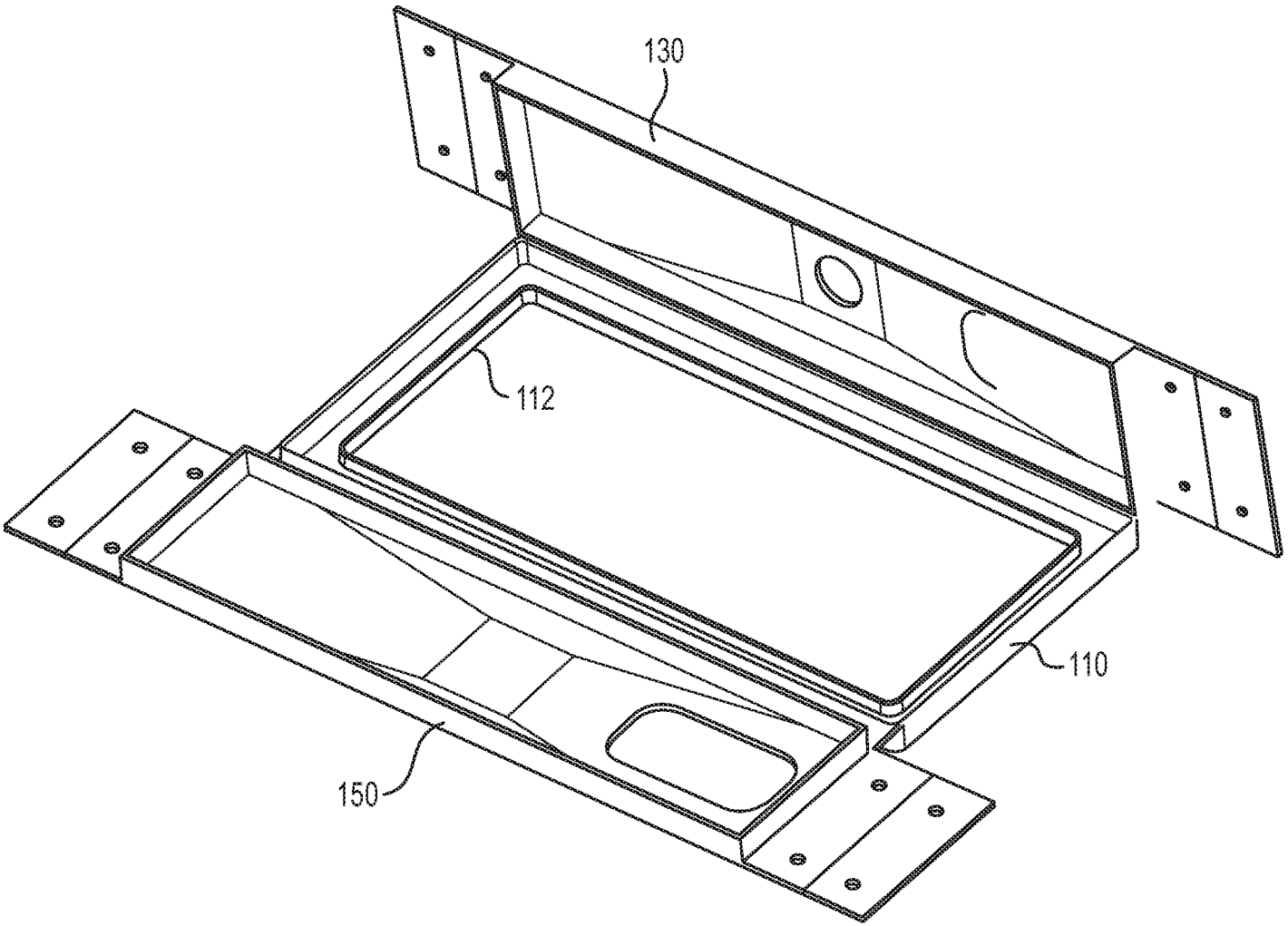
FIG. 3 shows the FIG. 1 rough-in box with the bottom surface folded into the installation position.

The top 150 and the bottom 130 of the box 100 can be identically configured with multiple score marks (knockouts) 152 (see FIG. 2) which enable the installer to easily select the optimum point for the lineset to enter the box, either from the top or from the bottom. Referring to FIG. 2, reference numeral 152 shows an example of where the score marks were used to knockout (form) a hole, and reference numeral 152' shows an example of where the score marks have not been used to knockout (form) a hole.

The top 150 and bottom 130 of the box also incorporate multiple round score marks 132 and 132' (knockouts), which enable the installer to select the drainage point which best suits the particular installation requirements. Referring to FIG. 2, reference numeral 132 shows an example of where the score marks were used to knockout (form) a hole, and reference numeral 132' shows an example of where the score marks have not been used to knockout (form) a hole. The knockouts can be sized to accommodate a ¾ inch or a ½ inch PVC or copper pipe adapter according to the requirements of the installer.

The top 150 and the bottom 130 preferably are identical so that the entire assembly is fully reversible and can be installed in any orientation.

Figure 4:
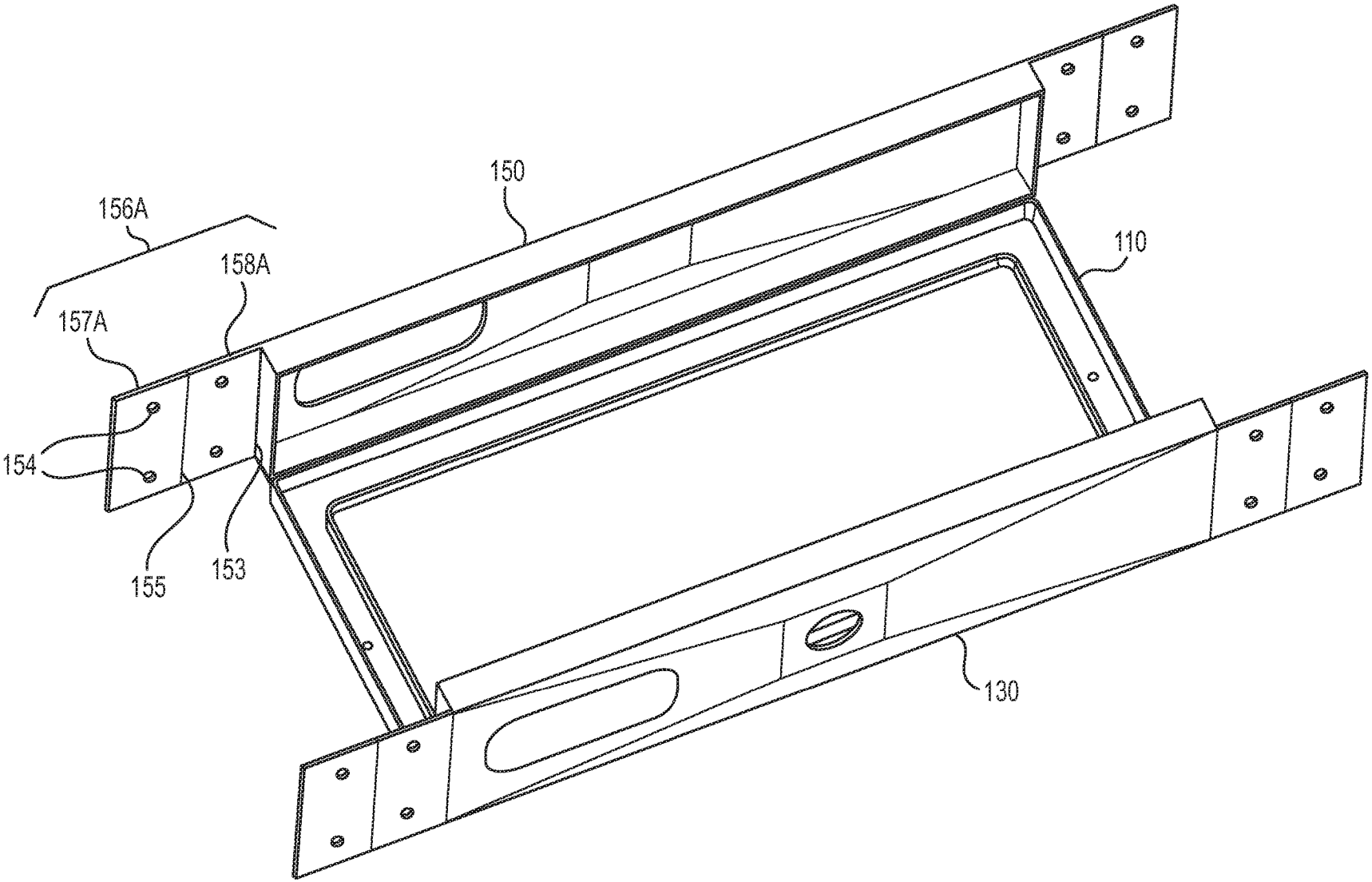
FIG. 4 shows the FIG. 1 rough-in box with the bottom and top surfaces folded into the installation position.
Figure 5:
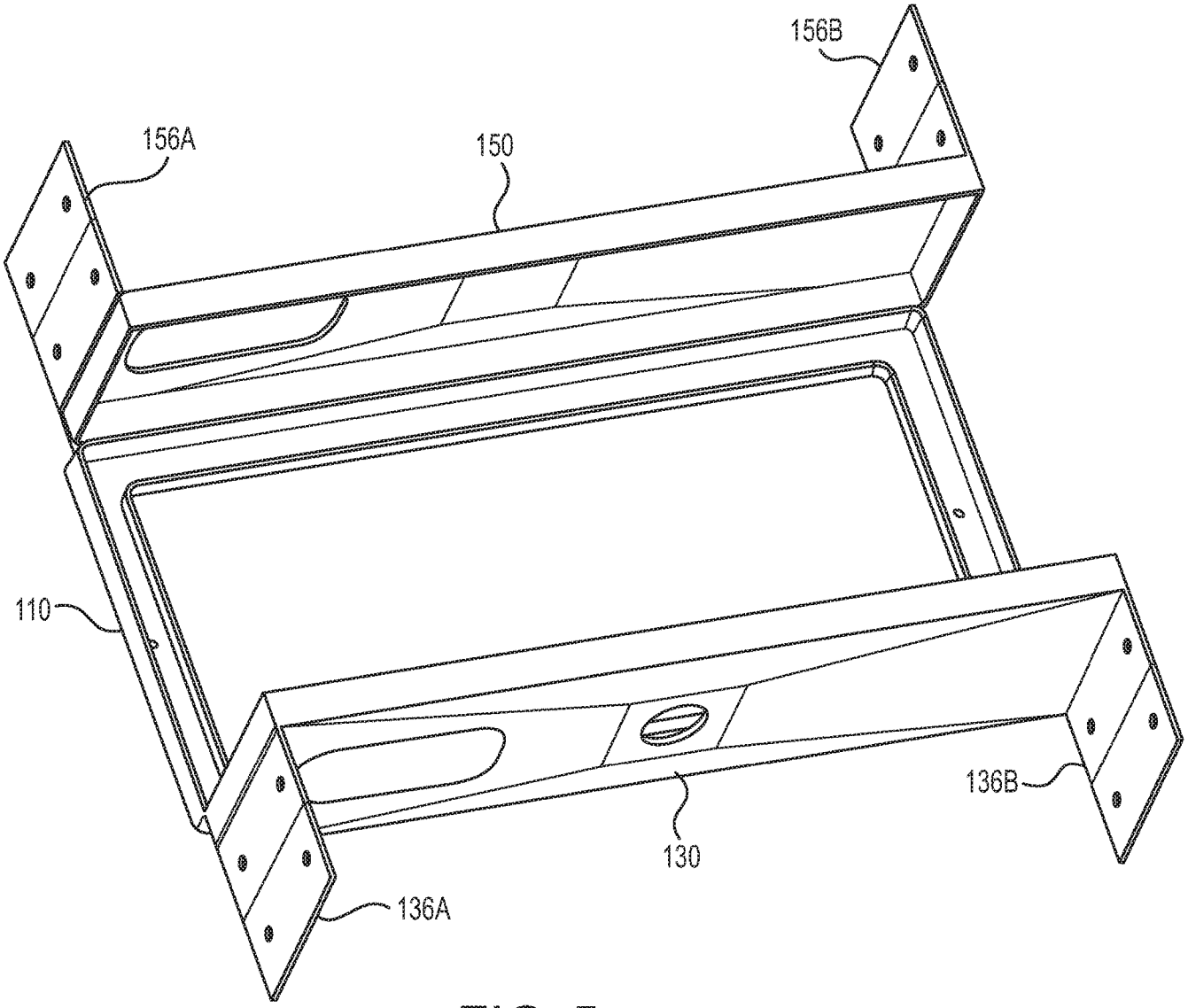
FIG. 5 is similar to FIG. 4 and shows the extension pieces (mounting brackets) of the top and bottom surfaces configured for mounting the box between studs that are spaced apart by a first, smaller distance (for example, 16 inches).
Figure 6:
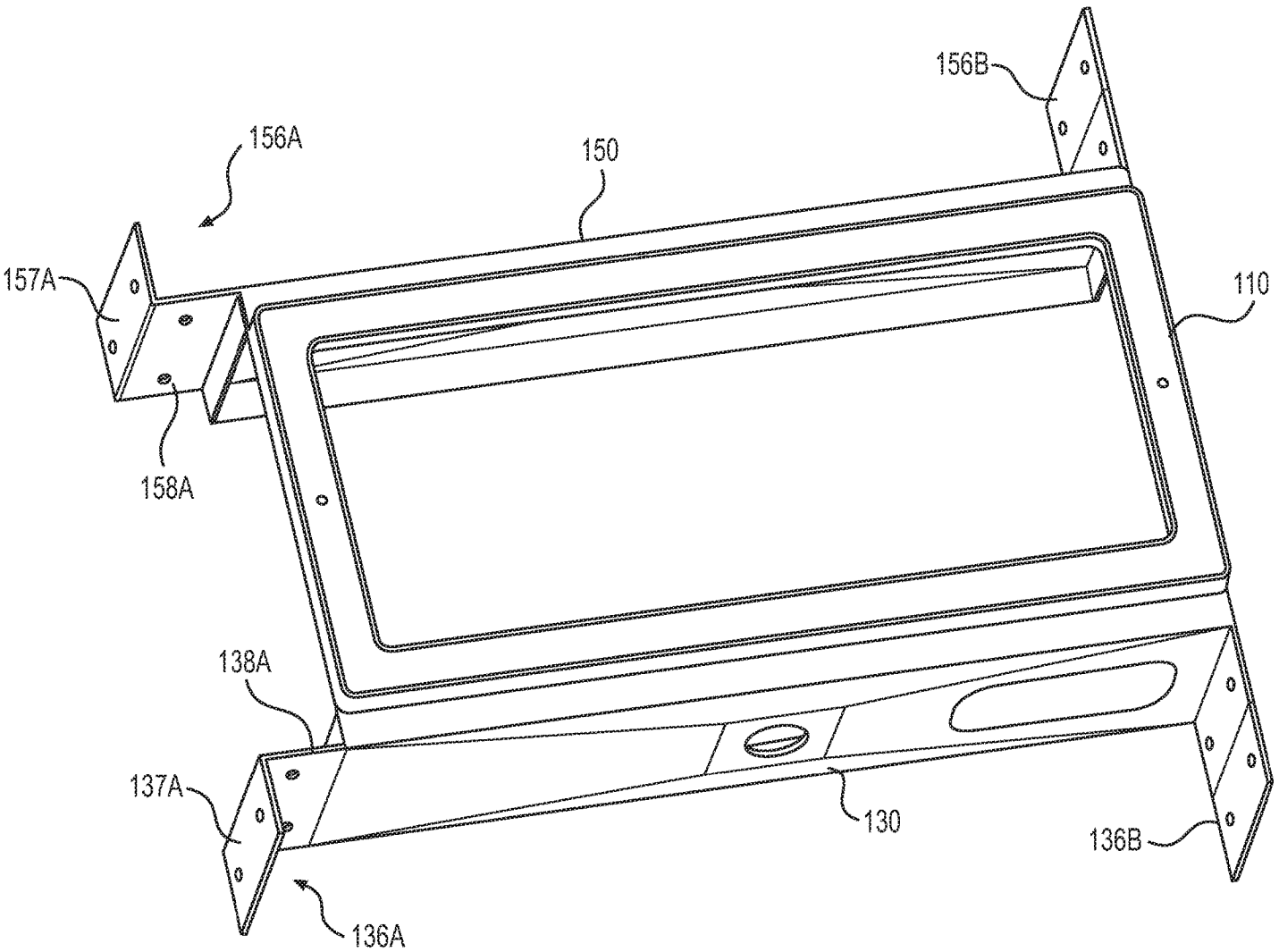
FIG. 6 is similar to FIG. 5 but shows the extension pieces (mounting brackets) on one side of the top and bottom surfaces configured differently from the extension pieces on the other side for mounting the box between studs that are spaced apart by a second distance that is larger than the first distance (for example, 20 inches).
Figure 7:
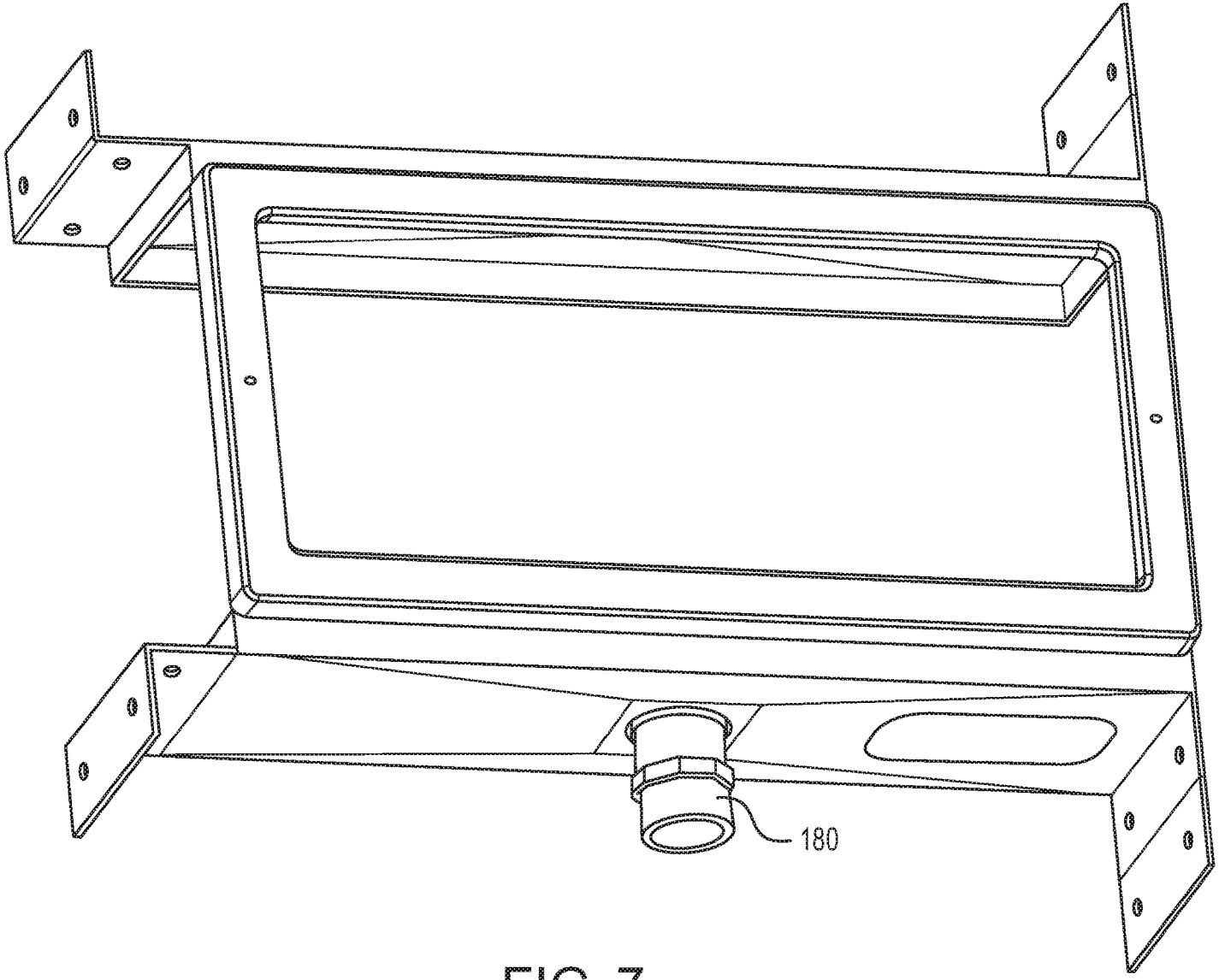
FIG. 7 is similar to FIG. 6 and shows the drain fitting mounted to the bottom surface of the rough-in box.
Figure 8:
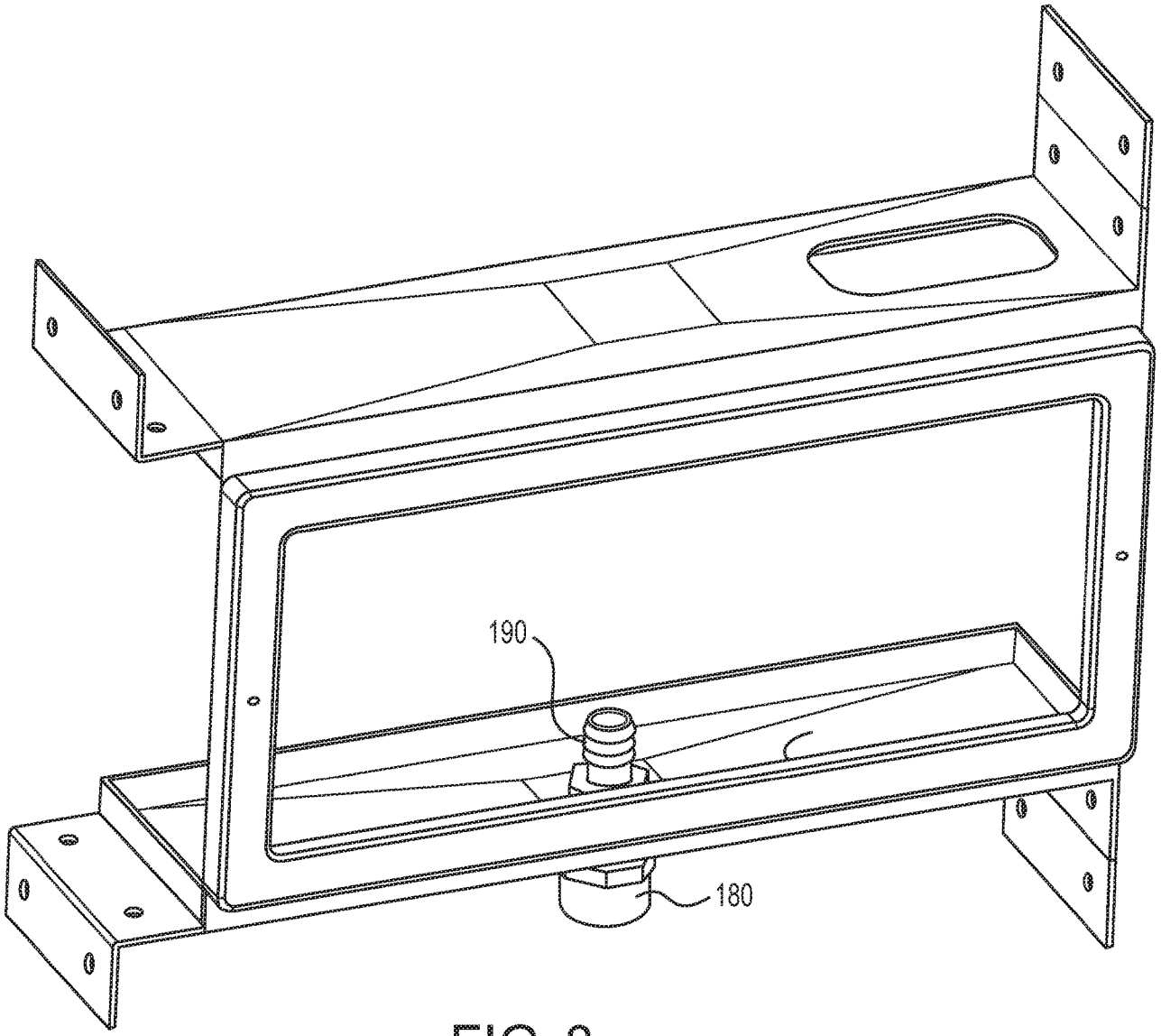
FIG. 8 is similar to FIG. 7 and also shows the quick connection structure for connecting a drain hose to the drain fitting on the inside of the rough-in box.
Figure 9:
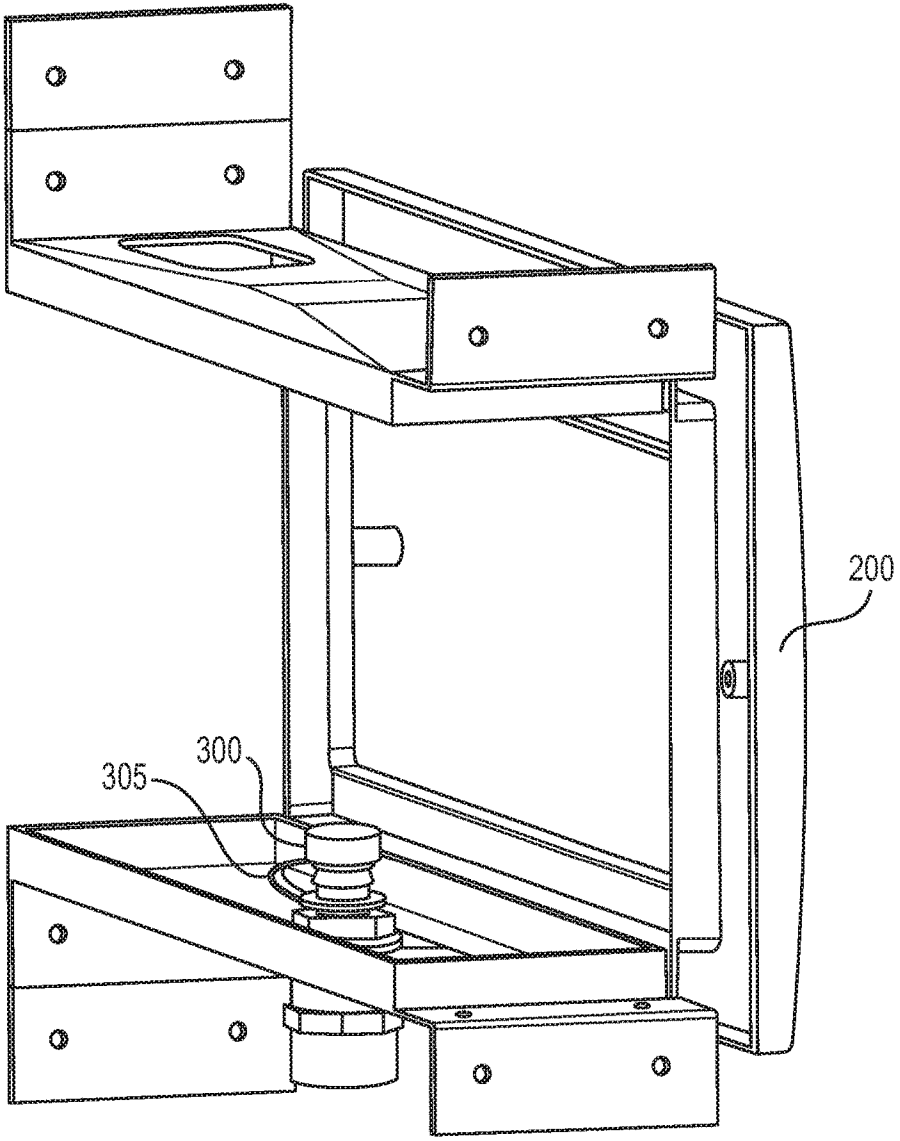
FIG. 9 shows the faceplate attached to the front surface of the rough-in box as viewed from the inside of the rough-in box.
Figure 10:
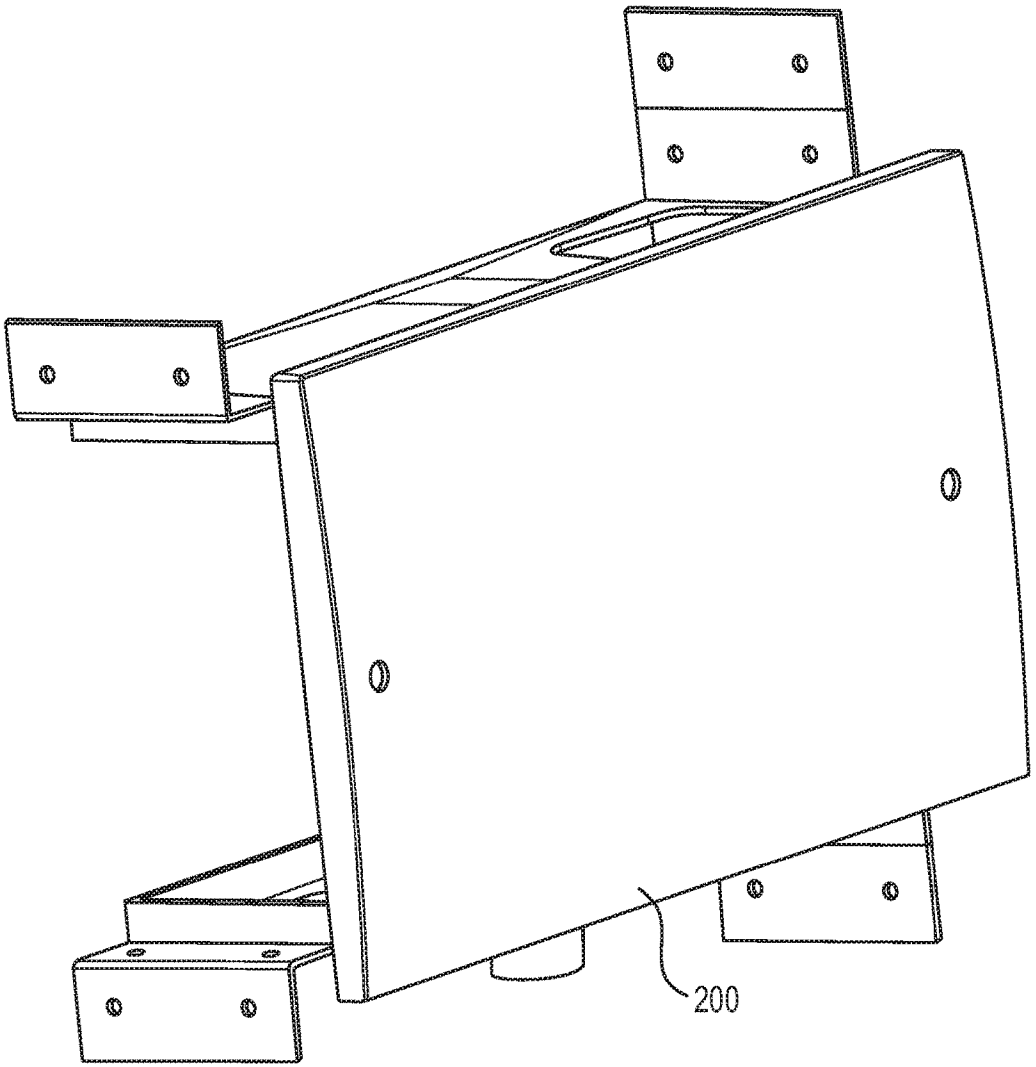
FIG. 10 shows the faceplate attached to the rough-in box as viewed from the outside of the rough-in box.

Both left and right ends of the top 150 and bottom 130 of the box incorporate extension pieces 136A, 136B, 156A, 156B (see FIG. 5) which function as mounting brackets for the box 100. The extension pieces 136A, 136B, 156A, 156B are predrilled to have holes 154 (see FIG. 4) for receiving screws or bolts, for example, and are scored in multiple places to enable the brackets to be configured for use in studs at 16 inch or 24 inch centers and also to be adjusted to suit the orientation of metal studs. For example, as shown in FIG. 4, the score mark 155 divides the extension piece 156A into two smaller extension pieces 157A, 158A. In addition, score mark 153 is provided between the extension piece 156A and the remainder of the top surface 150. Such structure enables the extension pieces to be configured (bent) into different orientations as shown in FIGS. 5 and 6, for example, for use with varying stud spacings. As shown in FIG. 6, one of the extension pieces 136A is bent along its central score mark so that the smaller extension pieces 137A and 138A extend in different directions that are perpendicular to each other. The same is done for the extension piece 156A as shown in FIG. 6. The FIG. 6 configuration is suitable for mounting between studs that are farther from each other than in the FIG. 5 configuration. Furthermore, if the extension pieces on both left and right sides of the box are bent at their central score marks, the box can be mounted between studs having an even larger spacing. For example, the FIG. 5 configuration could be suitable for a 16 inch stud spacing, whereas the FIG. 6 configuration could be suitable for a 20 inch stud spacing. In addition, if the extension pieces on both left and right sides of the box are bent at their central score marks (a configuration not shown in the drawings), such a configuration could be suitable for a 24 inch stud spacing.

The box 100 also comes with a ¾ inch drain fitting 180 (see FIGS. 7-10) which is supplied loose to enable it to be installed at whatever point is most convenient for the external and/or internal drain connection. The part of the drain fitting 180 which is inside the box includes a quick connection 190 for the drain hose from the evaporator and is configured to provide either a horizontal or vertical connection.

The part of the drain fitting outside the box is also configured to provide a vertical or horizontal connection for the drainage line.

It is preferable that the drain fitting be supplied with a removable protective cap 300 (see FIG. 9) attached to the drain fitting, for example, by a strap 305, to prevent debris from building operations from entering the drain line, which would comprise its integrity. The cap 300 preferably is fitted to the end of the fitting that is located inside the box after installation (i.e., to the quick connection 190). The cap 300 is then removed from the fitting when the drain hose from the evaporator is attached to the interior end of the drain fitting during the installation process of the evaporator. The protective cap can be in any shape, in any material and can be in the form of a loose cap which is attached to the exposed end of the drain fitting which is inside the box. The protective cap can be a friction fit, snap fitted, bayonet fitted, screwed on or use any other convenient means of attachment to the drain fitting which would enable it to be quickly and easily removed. Alternatively, the cap could be molded on to the exposed end of the drain fitting which is inside the box and then removed while the drain hose from the evaporator is being attached to the interior end of the drain fitting during the installation process of the evaporator. Whichever of the above methods is used, it is important that the cap has to be removed prior to the drain hose from the evaporator being attached to the interior end of the drain fitting inside the box, and thus the design of the cap must specifically preclude any possibility that the drain hose could be attached without removing the cap. Accordingly, the configuration of the cap, in any embodiment, must be such that it is impossible to attach the drain hose from the evaporator to the interior end of the drain fitting without removing the cap.

Rough-in boxes according to the invention can be fabricated from any kind of plastic, or any other kind of non metallic material including fiberglass or carbon fiber and can be produced by injection molding, vacuum molding, rotational molding, blow molding, printing or any other method of fabrication.

Rough-in boxes according to the invention can also be fabricated, pressed, printed or molded from any kind of metal.

The box can be square or rectangular in form or it could also be round, triangular or any other geometric shape which does not interfere with the required function.

As a secondary objective is to provide a definitive framed opening for the sheetrock installer, it is preferable for the box to have a front surface with an opening which protrudes through the sheetrock.

However, an alternative method makes it possible that the front surface could be supported to the studs either by a number of brackets along the top, bottom, or at either or both ends.

Another alternative method could have the front surface of the box supported to the studs by two endplates only, in which case the top and bottom surfaces could be eliminated.

What is claimed is:

1. An evaporator rough-in box comprising:

a substantially flat panel having (i) a first score mark by which the flat panel can be folded between a front wall and a top wall of the rough-in box, (ii) a second score mark by which the flat panel can be folded between the front wall and a bottom wall of the rough-in box, and (iii) an opening in the front wall through which an installer can access an interior of the rough-in box when installing an evaporator with which the rough-in box is to be used;

left and right ends of the top wall including top wall extension pieces that are bendably attached to a central portion of the top wall to form mounting brackets by which the left and right ends of the top wall can be attached to adjacent studs of a wall in which the rough-in box is to be mounted;

left and right ends of the bottom wall including bottom wall extension pieces that are bendably attached to a central portion of the bottom wall to form mounting brackets by which the left and right ends of the bottom wall can be attached to the adjacent studs of the wall in which the rough-in box is to be mounted;

hole-forming score marks formed in the central portions of the top and bottom walls, the hole-forming score marks delineating knock-out holes in the central portions of the top and bottom walls by which parts of the central portions can be removed to form holes by which a lineset and a drain line can be installed to the rough-in box;

a drain fitting that is removably attachable to one of the knock-out holes by which the drain line is installed to the rough-in box; and a cover plate that is removably attached to the front wall to cover the opening in the front wall.

2. The evaporator rough-in box according to claim 1, wherein:

the front wall includes a raised frame that protrudes from the front wall, the opening formed in the raised frame.

3. The evaporator rough-in box according to claim 2, wherein:

the raised frame includes mounting holes by which the cover plate is attached to the rough-in box.

4. The evaporator rough-in box according to claim 1, wherein:

the front wall includes mounting holes by which the cover plate is attached to the rough-in box.

5. The evaporator rough-in box according to claim 1, wherein:

the top and bottom walls are identically configured so that the central portion of each of the top and bottom walls has a first one of the hole-forming score marks delineating a first hole for the lineset and a second one of the hole-forming score marks delineating a second hole for the drain line.

6. The evaporator rough-in box according to claim 1, wherein:

at least one of the left and right extension pieces of both of the top and bottom walls includes score lines by which the at least one of the left and right extension pieces can be folded for mounting of the rough-in box between the adjacent studs spaced from each other by either a first distance or a second distance greater than the first distance.

7. The evaporator rough-in box according to claim 1, wherein:

both of the left and right extension pieces of both of the top and bottom walls include score lines by which the left and right extension pieces can be folded for mounting of the rough-in box between the adjacent studs spaced from each other by either a first distance, a second distance greater than the first distance, or a third distance greater than the second distance.

8. The evaporator rough-in box according to claim 1, wherein:

the left and right extension pieces of both of the top and bottom walls include mounting holes by which the left and right extension pieces can be attached to the adjacent studs of the wall in which the rough-in box is mounted.

9. The evaporator rough-in box according to claim 1, further comprising:

a removable cap that is removably attached to a first end of the drain fitting.

10. The evaporator rough-in box according to claim 9, wherein:

the removable cap is removably attached to an interior end of the drain fitting.

11. The evaporator rough-in box according to claim 1, wherein:

an interior end of the drain fitting includes a quick connection.

12. The evaporator rough-in box according to claim 1, wherein:

the substantially flat panel is made from a plastic material.

* * * * *